United States Patent [19]

Bronstad et al.

[11] Patent Number: 4,678,166

[45] Date of Patent: Jul. 7, 1987

[54] ECCENTRIC LOADER GUARDRAIL TERMINAL

[75] Inventors: Maurice E. Bronstad, San Antonio, Tex.; James H. Hatton, Jr., Washington, D.C.; Leonard C. Meczkowski, Herndon, Va.

[73] Assignee: Southwest Research Institute, San Antonio, Tex.

[21] Appl. No.: 855,852

[22] Filed: Apr. 24, 1986

[51] Int. Cl.[4] ..... E01F 15/00

[52] U.S. Cl. ..... 256/13.1; 256/19

[58] Field of Search ..... 256/13.1, 19

[56] References Cited

U.S. PATENT DOCUMENTS

| | | | |
|---|---|---|---|
| 1,930,985 | 10/1933 | Schulz | 256/13.1 |
| 3,307,833 | 3/1967 | Muller et al. | 256/13.1 |
| 3,332,666 | 7/1967 | Gray | 256/13.1 |
| 3,436,057 | 4/1969 | Mazelsky | 256/13.1 |
| 3,643,924 | 2/1972 | Fitch | 256/13.1 |
| 3,845,936 | 11/1974 | Boedecker et al. | 256/13.1 X |
| 4,290,585 | 9/1981 | Graesener | 256/13.1 |
| 4,607,824 | 8/1986 | Krage et al. | 256/13.1 |

*Primary Examiner*—Richard J. Scanlan, Jr.

*Attorney, Agent, or Firm*—Fulbright & Jaworski

[57] ABSTRACT

A guardrail terminal for use at the upstream end of a conventional guardrail consisting of a plurality of joined together horizontally extending W-beam guardrails which are layered in a curve away from the traffic side of the guardrail in an upstream direction. An eccentric lever is connected to the upstream end of the terminal for introducing a bending moment on the terminal whereby an impacting vehicle at the upstream end will facilitate buckling of the rails and allow the vehicle to pass behind the terminal instead of being speared or spun around by an end on impact. The rails are supported by break-away supports and the rails are secured to only the first upstream vertical support but are laterally movable relative to the other vertical supports. The lever includes a metal beam connected perpendicular to the upstream end and extends away from the traffic side and a tubular member encloses the first support, the metal beam and the end of the upstream rail.

6 Claims, 14 Drawing Figures

Fig. 1A
(PRIOR ART)
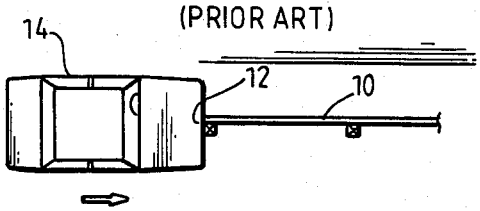
Fig. 2A
(PRIOR ART)
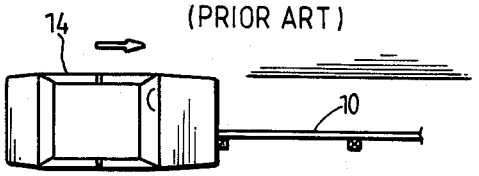
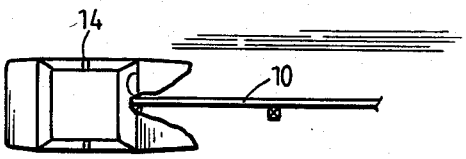
Fig. 1B
(PRIOR ART)
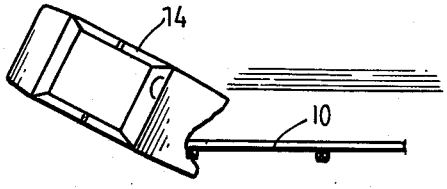
Fig. 2B
(PRIOR ART)
Fig. 3A
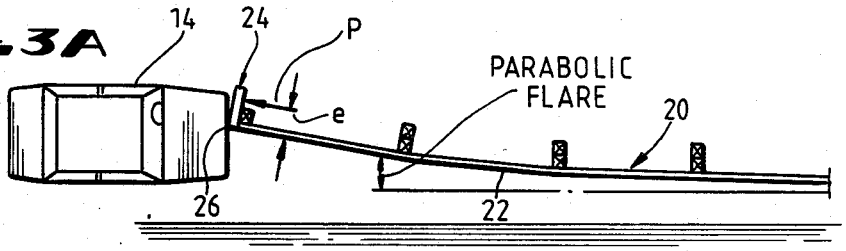
Fig. 3B
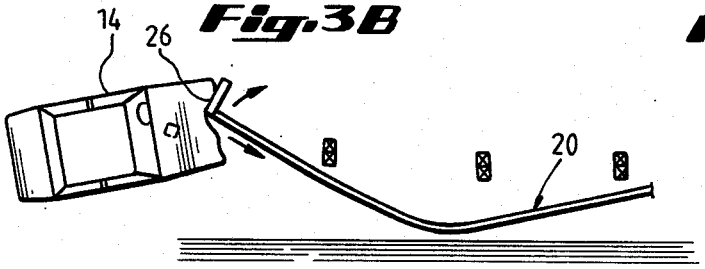
Fig. 3C
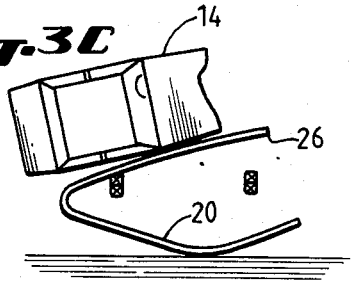
Fig. 10
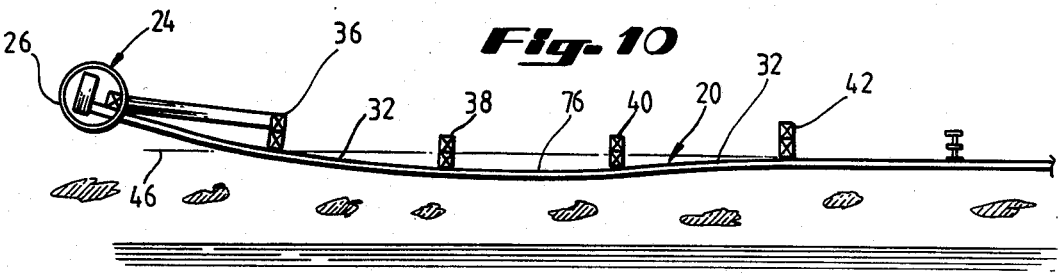

Fig. 7
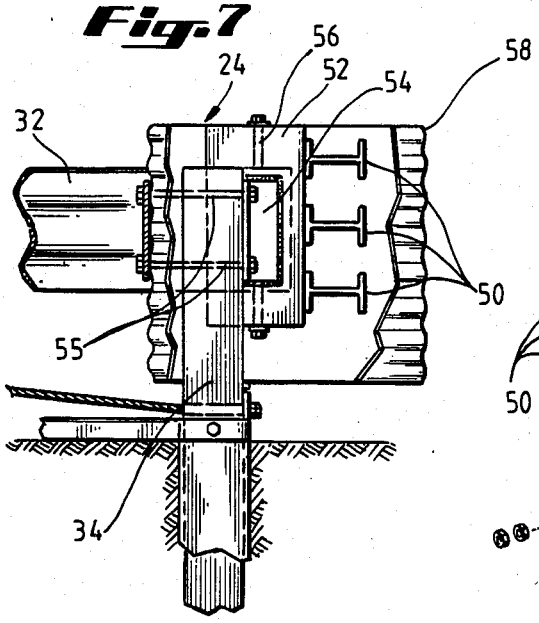
Fig. 8
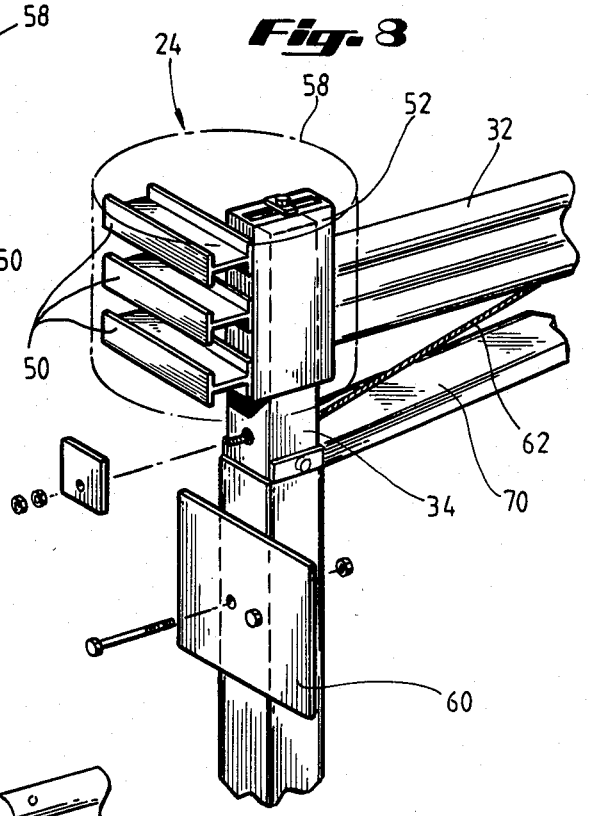
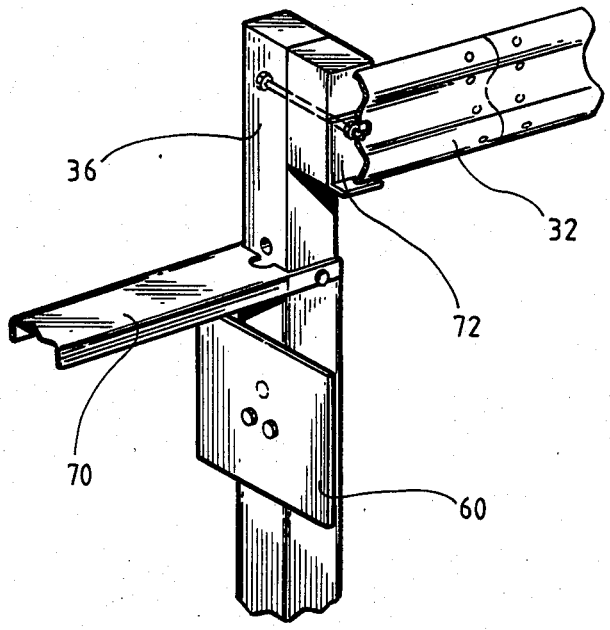
Fig. 9

ECCENTRIC LOADER GUARDRAIL TERMINAL

BACKGROUND OF THE INVENTION

The patent invention was made in the course of a contract with the Federal Highway Administration of the United States of America, Contract No. DTFH61-81-C-00076.

Guardrails are traffic barriers placed along the roadside to screen errant vehicles from hazards behind the barrier. The most common guardrail in the United States is constructed using the standard steel W-beam mounted on spaced wood or steel posts. Because the W-beam functions primarily in tension when redirecting impacting vehicles, a function of the end is to provide necessary anchorage for the beam to develop necessary tensile forces. However, since the guardrail end represents a discontinuity in the barrier system, it is subject to being struck "head-on" by vehicles with small departure angles from the roadway. These head-on impacts have proved to be dangerous with W-beam barriers because of the significant spearing strength of the beam element. Some widely used terminal designs "bury" the W-beam at the end to eliminate spearing, but this design has been shown to cause vaulting and rollover due to the vehicle riding up the end, and subsequently becoming airborne.

The present invention is directed to an eccentric loader guardrail terminal for use at the upstream end of a guardrail for overcoming the problems of spearing and spin when a vehicle impacts the upstream or approach end of the terminal in a head-on impact. The terminal is flared away from the traffic side of the guardrail in an upstream direction and includes an eccentric lever connected to the upstream end for creating a bending moment on the terminal to facilitate buckling of the W-beams and permit the vehicle to pass behind the terminal.

SUMMARY

The present invention is directed to an eccentric loader guardrail terminal for use at the upstream end of a conventional guardrail and consists of a plurality of joined together horizontally extending W-beam guardrails. A plurality of vertical supports vertically support the W-beam guardrails. The plurality of rails flare away from the traffic side of the guardrail in an upstream direction. An eccentric lever means is connected to the upstream end of the plurality of rails whereby an impacting vehicle at the upstream end will facilitate buckling of the rails allowing the vehicle to pass behind the terminal.

A still further object of the present invention is wherein the vertical supports are breakaway posts for reducing possible rollover of an impacting vehicle.

Yet a further object of the present invention is wherein the flaring of the rails is curved and is preferably parabolic shaped.

Still a further object of the present invention is wherein the plurality of rails are secured to the first upstream vertical support but are laterally movable relative to the other vertical supports for lateral bending.

Yet a still further object of the present invention is wherein said rails include a bowed-out portion towards the traffic side of the terminal at a location remote from the upstream end of the terminal for increasing the curvature of the flaring.

Still a further object of the present invention is wherein the eccentric lever means includes a breakaway post at the upstream end of the terminal, a metal beam connected perpendicular to the end rail and extending away from the traffic side of the terminal, and a tubular member enclosing the post, metal beam and the end of the upstream rail and is secured to the post. The lever not only provides an eccentric bending moment on the rails when impacted head-on, but distributes the resisting force of the impacted rails over a large area of the impacting vehicle.

Other and further objects, features and advantages will be apparent from the following description of presently preferred embodiments of the invention, given for the purpose of disclosure, and taken in conjunction with the accompanying drawings.

BREIF DESCRIPTION OF THE DRAWINGS

FIGS. 1A and 1B schematically illustrate a standard guardrail spearing a vehicle impacting the upstream end of the guardrail, FIGS. 2A and 2B schematically illustrate a conventional guardrail being impacted by a vehicle at its upstream end causing the vehicle to turn or spin, FIGS. 3A, 3B and 3C are plan views of the eccentric guardrail terminal of the present invention being impacted by a vehicle in a head-on collison but in which the vehicle is allowed to bend the terminal and pass safely behind the terminal, FIG. 4 is an enlarged plan view of the eccentric flared guardrail terminal of the present invention, FIG. 5 is a front elevational view of the structure of FIG. 4, FIG. 6 is an enlarged plan view of the approach or upstream end of the guardrail terminal of the present invention, FIG. 7 is a cross-sectional view taken along the line 7—7 of FIG. 6, FIG. 8 is an enlarged perspective view of the upstream end of the terminal of the present invention, FIG. 9 is an enlarged fragmentary perspective view of the structure at the second post from the upstream end of the present terminal, and FIG. 10 is a plan view of another embodiment of the present invention.

DESCRIPTION OF THE PREFERRED EMBODIMENTS

Figure 4:
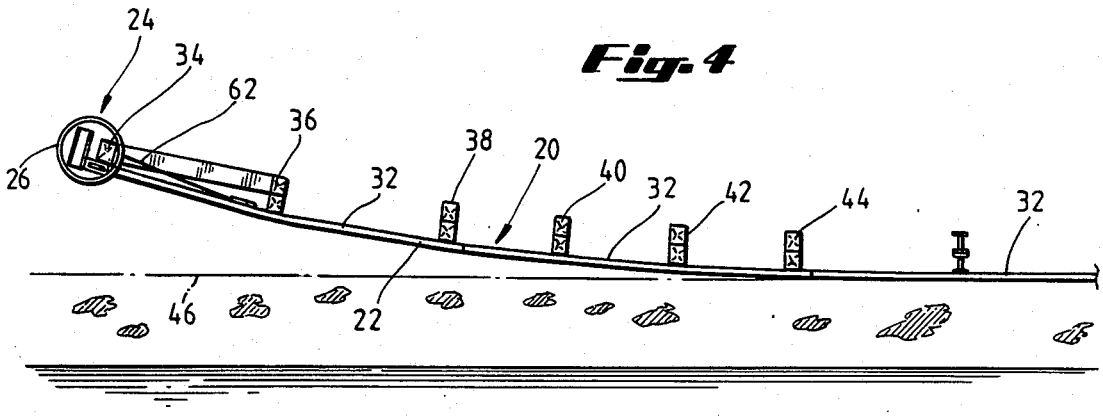

Referring now to FIGS. 1A and 1B, one of the problems of the prior art conventional standard steel W-beam guardrail 10 is shown. Because the guardrail 10 functions primarily in tension for redirecting impacting vehicles, a function of the end 12 of the guardrail 10 is to provide necessary anchorage so that the guardrail 10 develops the necessary tensional forces for redirecting vehicles which strike the guardrail 10. However, the guardrail 10 represents a discontinuity and is subject to being struck "head-on" by a vehicle 14 as illustrated in FIG. 1B these head-on impacts have proved to be extremely damaging to the vehicle 14 as well as dangerous to the occupants of the vehicle 14. The standard W-beam has sufficient strength to violently spear and/or spin a vehicle when impacted end-on.

As illustrated in FIGS. 2A and 2B, where the vehicle 14 impacts the conventional guardrail 10 at an off-center location of the vehicle 14, a dangerous turn or spin is applied to the vehicle 14 by the guardrail 10. Furthermore, such conventional guardrails do not maintain vehicle decelerations within recommended limits.

Various qualification tests described in the National Cooperative Highway Research Project Report 230 provide various testing criteria in order to provide a crash worthy end terminal which does not spear, vault or roll a vehicle upon head-on impacts while maintaining vehicle decelerations within recommended limits, and provide anchorage to develop the longitudinal strength of the guardrail throughout its length.

Referring now to FIGS. 3A, 3B and 3C, the present invention is directed to an eccentric loader guardrail terminal generally indicated by the reference numeral 20 which is curved and flared away from the traffic side 22 in an upstream direction and in which the column strength of the W-beams are reduced by omitting the posts to rail bolts, and an eccentric lever 24 is provided at the approach or upstream end of the terminal 20. The eccentric lever 24 is connected to the terminal 20 but extends away from the traffic side 22 to create a resistive force P which is offset an eccentric distance e to induce a moment at the end 26 of the terminal 20 which reduces the force needed to overcome the column strength of the terminal 20, thus facilitating buckling in the W-beams of the terminal 20. As illustrated in FIGS. 3B and 3C when the vehicle 14 hits the end 26 of the terminal 20, the vehicle is decelerated and permitted to pass behind the terminal 20 without incurring the spearing or spin of a conventional guardrail as described in FIGS. 1A, 1B, 2A and 2B. The eccentric lever reduces the forces on an impacting vehicle sufficiently to keep the vehicle stable and permit it to run out behind the terminal.

Figure 5:
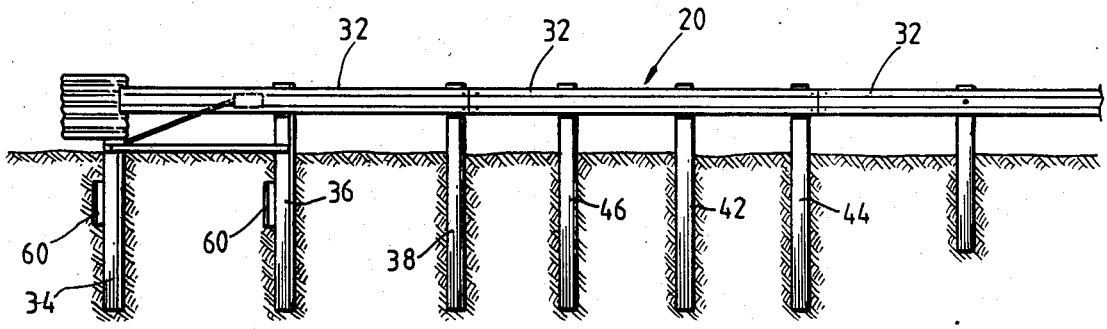

Referring now to FIGS. 4 and 5, the eccentric loader guardrail terminal 20 of the present invention is shown for use at the upstream end of a conventional guardrail 30. The terminal 20 consists of a plurality of joined together horizontally extending W-beam guardrails 32. The guardrails 32 are spliced together and a plurality of vertical supports 34, 36, 38, 40, 42, and 44 of any suitable number, such as six, are provided for vertically supporting the W-beam guardrails 32. The plurality of rails 32 flare away from the traffic side 22 of the terminal 20 in an upstream direction and preferably in a parabolic flare. That is, the joined beams 32 flare away from a tangent 46 to the guardrail 30 so that the upstream end 26 of the terminal 20 is positioned the greatest distance from the tangent line 46.

An eccentric lever means generally indicated by the reference numeral 24 is connected to the upstream end 26 of the plurality of joined rails 32 whereby an impacting vehicle at the upstream end will facilitate buckling of the rails allowing the vehicle to pass behind the terminal 20.

Figure 6:
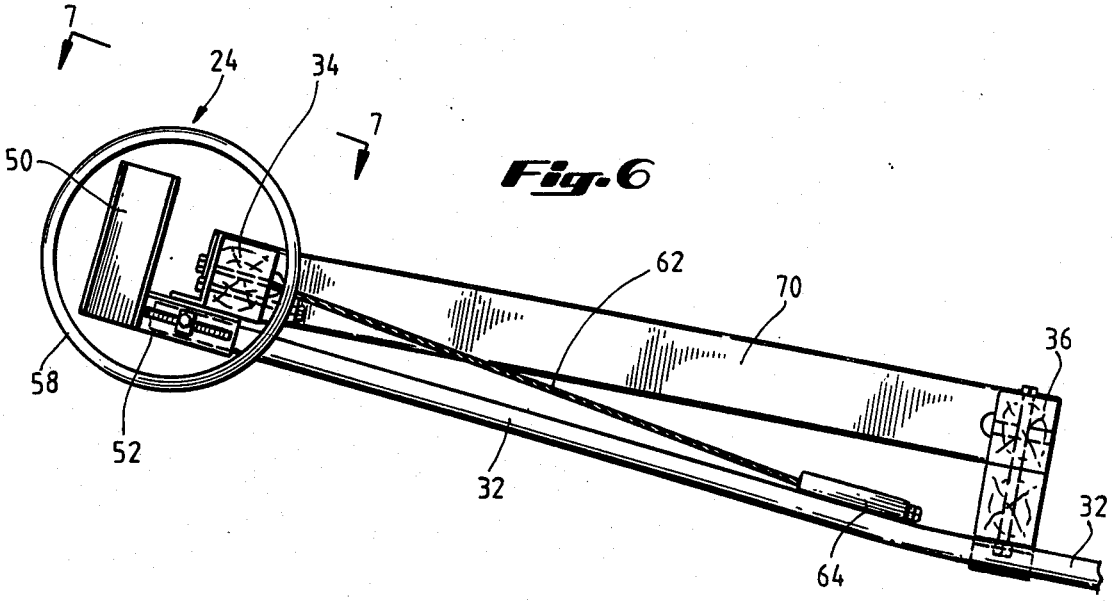

Referring now to FIGS. 6, 7 and 8, a more detailed description of the eccentric lever 24 is best seen. The lever 24 includes a plurality of metal beams such as H beams 50, which are secured to a beam box 52 such as by welding which in turn is connected to an angle iron 54 which is bolted by bolts 55 to post 34. In addition, the beam 52 is connected to the end of the upstream rail 32 by a bolt 56 passing through the splice holes of the end of the beam 32 Enclosing the beams 50, 52, the top of the support 34 and the end of the W-beam 32 is a tubular member 58 such as a corrugated portion of a metal culvert. The tubular member 58 is supported by being bolted to the support 34 by the bolts 55. The purpose of the bolt 56 is to prevent the lever 24 and W-beam 32 from being separated after impact. The tubular member 58 provides a barrier to the end of the rail 32 and the beams 50 and spreads the resisting load of the terminal 20 over a large area of the impacting vehicle.

Preferably, all of the supports 34, 36, 38, 40, 42 and 44 are break-away posts with the bottoms of supports 34 and 36 being steel tubes with soil bearing plates 60 to increase resistance to longitudinal movement. Preferably the posts 38, 40, 42 and 44 are wood posts with drilled holes at or below ground line to make them break away. The breakaway posts avoid the problem of posts which bend over on impact and cause the vehicle to roll over or be launched.

Referring to FIGS. 4–8, a conventional anchor cable 62 is provided connected to the first post 34 and to a connection 64 on the most upstream rail 32 to provide the necessary tensile forces to redirect impacting vehicles downstream from the end 26. Because the rails 32 are not secured to the posts 36, 38, 40, 42 and 44 by post or rail bolts, there is an additional load transmitted to the anchor cable 62. Therefore, a strut 70 is provided between the steel tube foundations of posts 34 and 36 so that the strut 70 acts along with the cable 62 to resist cable loads caused by impacts downstream of the attachment 64.

As previously mentioned, the rails 32 are not connected by bolts to the posts 36, 38, 40, 42 and 44, but as best seen in FIG. 9 in connection with posts 36 a shelf angle 72 is provided connected to the post 36 for vertically supporting the rails 32, but allowing the rails 32 to be laterally movable relative to the posts. This allows the terminal 20 to buckle and bend as best seen in FIGS. 3B and 3C.

Referring now to FIG. 4, if the end 26 is displaced a sufficient distance from the tangent line 46 the lever 24 can be omitted. However, this is generally not possible because of the constraints of the installation. In fact, in many situations there is not sufficient room to displace the ends 26 sufficiently from the tangent line 46 to provide enough flare or curve to facilitate the desired buckling. In such circumstances and referring to FIG. 10, the rails may be bowed out towards the traffic side 22 at a location remote from the upstream end 26 for increasing the curvature of the flaring section. That is, a bowed portion 76 is provided extending on the traffic side of the tangent line 46 for increasing the curvature near the end 26 for reducing the column strength of the plurality of rails 32.

In actual crash tests, the terminal 20 as shown in FIG. 4 sucessfively passed the required tests in which the end 26 was offset from the tangent line 46 four feet for a terminal 20 length of approximately 37 feet. However, the embodiment shown in FIG. 10 for an offset of the end 26 from the tangent line 46 of only one and one half-feet was able to satisfactorily pass tests by having an offset bow 76 bowed past the tangent line 46 of approximately eight inches.

The relatively low cost present invention has, in actual tests, met all of the crash test requirements currently specified by the National Cooperative Highway Program Report No. 230.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will be readily apparent to those skilled in the art and which are encompassed within the spirit of the invention and the scope of the appended claims.

What is claimed is:

1. An eccentric loader guardrail terminal for use at the upstream end of a guardrail comprising, a plurality of joined together horizontally extending W-beam guardrails, a plurality of vertical supports for vertically supporting said W-beam guardrails, said vertical supports are breakaway posts, said plurality of rails flaring away from the traffic side of the guardrail in an upstream direction, and an eccentric lever means connected to the upstream end of the plurality of rails whereby an impacting vehicle at the upstream end will facilitate buckling of the rails allowing the vehicle to pass behind the terminal.

2. An eccentric loader guardrail terminal for use at the upstream end of a guardrail comprising, a plurality of joined together horizontally extending W-beam guardrails, a plurality of vertical supports for vertically supporting said W-beam guardrails, said plurality of rails flaring away from the traffic side of the guardrail in an upstream direction, and an eccentric lever means connected to the upstream end of the plurality of rails whereby an impacting vehicle at the upstream end will facilitate buckling of the rails allowing the vehicle to pass behind the terminal, said rails are secured to the first upstream vertical support but laterally movable relative to the other vertical supports.

3. An eccentric loader guardrail terminal for use at the upstream end of a guardrail comprising, a plurality of joined together horizontally extending W-beam guardrails, a plurality of vertical supports for vertically supporting said W-beam guardrails, said plurality of rails flaring away from the traffic side of the guardrail in an upstream direction, and an eccentric lever means connected to the upstream end of the plurality of rails whereby an impacting vehicle at the upstream end will facilitate buckling of the rails allowing the vehicle to pass behind the terminal, said rails including a bowed out portion towards the traffic side of the terminal at a location remote from the upstream end of the terminal for increasing the curvature of the flaring.

4. An eccentric loader guardrail terminal for use at the upstream end of a guardrail comprising, a plurality of joined together horizontally extending W-beam guardrails, a plurality of vertical supports for vertically supporting said W-beam guardrails, said plurality of rails flaring away from the traffic side of the guardrail in an upstream direction, and an eccentric lever means connected to the upstream end of the plurality of rails whereby an impacting vehicle at the upstream end will facilitate buckling of the rails allowing the vehicle to pass behind the terminal, said eccentric lever includes, a breakaway post at the upstream end of the terminal, a metal beam connected perpendicular to the end rail and extending away from the traffic side of the terminal, a tubular member enclosing the post, metal beam and the end of the upstream rail and secured to the post.

5. An eccentric loader guardrail terminal for use at the upstream end of a conventional straight guardrail comprising, a plurality of joined together horizontally extending W-beam guardrails for connection to the upstream end of a conventional straight guardrail, a plurality of vertical breakaway supports for vertically supporting said W-beam guardrails, said plurality of rails being curved and flaring away from the traffic side of the guardrail from the conventional guardrail in an upstream direction, said rails being secured to the first upstream vertical support but laterally movable relative to the other vertical supports, and an eccentric lever means connected to the upstream end of the joined rails and extending away from the traffic side of the rails whereby an impacting vehicle at the upstream end will facilitate buckling of the rails allowing the vehicle to pass behind the terminal.

6. The apparatus of claim 5 wherein the eccentric lever includes, a breakaway post at the upstream end of the terminal, a metal beam connected perpendicular to the end rail and extending away from the traffic side of the terminal, and a tubular member enclosing the post, metal beam and the end of the upstream rail and secured to the post.

* * * * *